United States Patent [19]

Seragnoli

[11] 3,968,628

[45] July 13, 1976

[54] TWIST FINGER APPARATUS FOR WRAPPING CANDIES AND THE LIKE

[75] Inventor: Enzo Seragnoli, Bologna, Italy

[73] Assignee: G. D. Societa per Azioni, Italy

[22] Filed: Dec. 2, 1974

[21] Appl. No.: 528,662

[30] Foreign Application Priority Data

Dec. 20, 1973 Italy ..... 3546/73

[52] U.S. Cl. ..... 53/370; 269/228

[51] Int. Cl.[2] ..... B65B 7/12

[58] Field of Search ..... 53/181, 370; 269/228, 269/278

[56] References Cited

UNITED STATES PATENTS 1,766,812 6/1930 Danserell ..... 269/228 UX

FOREIGN PATENTS OR APPLICATIONS 551,967 11/1956 Italy ..... 53/370

*Primary Examiner*—Leon Gilden

*Attorney, Agent, or Firm*—Robert E. Burns; Emmanuel J. Lobato; Bruce L. Adams

[57] ABSTRACT

Apparatus for opening and closing twist finger assemblies for wrapping candies and similar products. Two twist fingers are symmetrically pivoted to a forked end portion of a rotating and axially sliding sleeve, and each finger has an extension radial with respect to its pivot, in the forked end of the sleeve. A slidable rod extends through the sleeve and to adjacent the pivots of the fingers. Two links are provided in the forked end portion of the sleeve; each of them has one end articulated to a common pivot pin at an end of the rod, and has another end articulated to an end of the extension of the finger.

7 Claims, 3 Drawing Figures

Fig.1
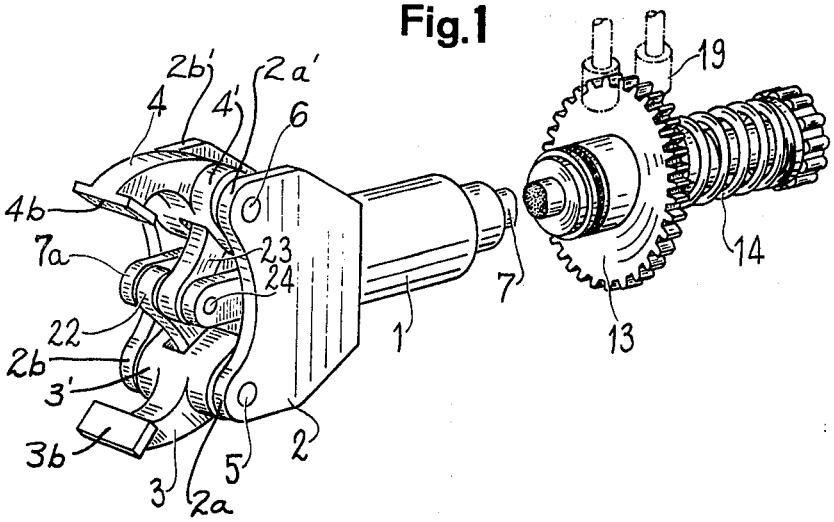
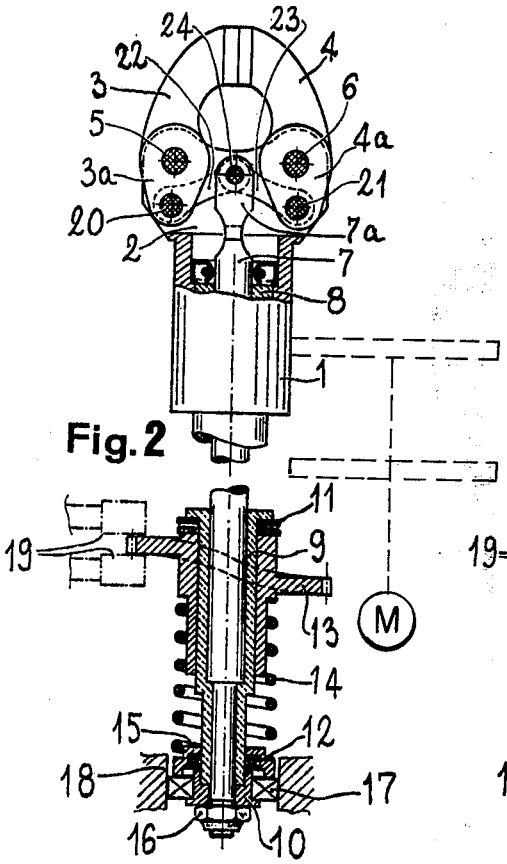
Fig.2
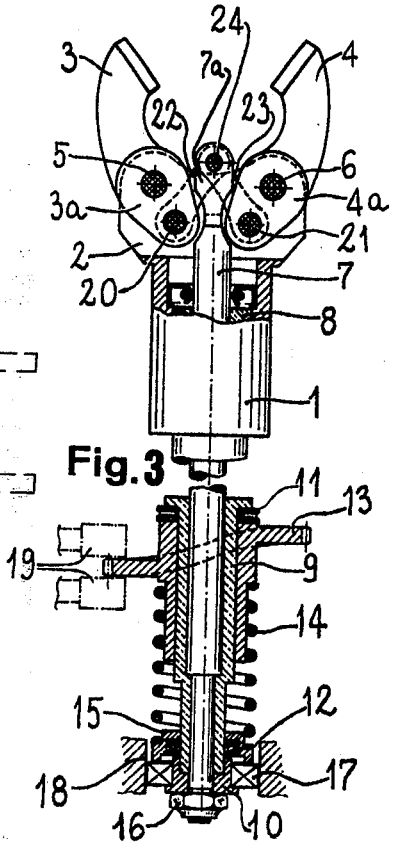
Fig.3

TWIST FINGER APPARATUS FOR WRAPPING CANDIES AND THE LIKE

BACKGROUND OF THE INVENTION

The present invention relates to the devices known as twist finger assemblies mounted on machines for wrapping candies or similar products in what is known as the 'single end' ('side bow') or the 'double end' twist style and, to be more precise, has as its subject a device for opening and closing the twist fingers on the said assemblies.

DESCRIPTION OF THE PRIOR ART

With machines for wrapping candies or similar products, the method is already used of creating a tubular wrap around the product to be wrapped and of having folding mechanism at the opposite ends of the said wrap with which to fashion it into the desired style: for example, the 'point wrap' style, the 'soap/diamond' style, the 'single end twist' ('side bow') style, the 'double end twist' style and in other styles too.

In the particular case of what are called the 'single end twist' ('side bow') and the 'double end twist' styles of wrap, the use is known of what are called twist finger assemblies positioned along the wrapping track of the wrapping machine which, when brought into operation, grasp the opposite end/s of the tubular wrap, rotate around their axis which generally coincides with that of the tubular wrap and simultaneously move closer to the product because of the wrap having got shorter as a result of the twist/s given to the end/s to suit the desired wrapping style.

On all the devices of this type known to date, the twist finger assemblies are made to open their fingers, to grasp the end/s of the tubular wrap, rotate, progressively move closer to the product, and return to their initial position. This is done either by means of cams keyed onto one single drive shaft and levers associated thereto, or through toggle lever systems which operate the various parts, see for example, British Pat. Nos. 442,803 and 699,422, German Pat. Nos. 650,533 and 885,227 and Italian Pat. No. 466,665, l or, according to Patent Application Ser. No. 528,663 filed on the same day herewith by; the same applicant as herein, it is done directly by disk means rotatable and slidable on a sleeve and rod.

The twist fingers have been opened and closed by means of a rod, resiliently reciprocated in the sleeve, which has been provided at one end with a rack meshing with a gear segment on each of the fingers concentrically with a pivot pin for the closing and opening operations.

With this rack operating mechanism meshing with the annular toothing of the twist fingers, what happens in actual practice is that when twist finger assemblies of this nature are used on high unit output speed wrapping machines, for example, of the type described in British Pat. No. 1,259,912 and in Italian Pat. No. 862,104, the fingers frequently get broken and the breakage generally occurs in the area of the annular toothing where the pressure reacting to the grip applied by the fingers to the part of the wrap to be twisted, is the greatest.

SUMMARY OF THE INVENTION

The object of the present invention is to overcome the aforementioned problem by providing a device for opening and closing the fingers on twist finger assemblies which can be used even on high speed wrapping machines without any kind of breakage being caused.

This and other objects too have been attained with the device according to the invention the fingers on the twist finger assemblies, mounted on machines for wrapping candies or similar products, particularly high speed wrapping machines, in order to fashion a tubular wrap in what is known as the 'single end' ('side bow') or the 'double end' twist style of wrap, are symmetrically pivoted to one end of an axially guided sliding sleeve and there is a rod that also slides and is guided in an axial direction in the inside of the sleeve, one end of which extends adjacent to the point where the pivot pins of the fingers are located. Means are provided for causing the sleeve and rod to rotate in unison. The fingers are each provided with a protrusion radial with respect to their pivot pin and there are two links, each of which is articulated at one end to a common pivot pin at the one end of the aforementioned rod, and at the other, to the extremity of the radial protrusion of one of the twist fingers.

BRIEF DESCRIPTION OF THE DRAWINGS

Further characteristics and advantages will emerge more clearly from the following detailed description of a preferred but not the sole form of embodiment for the device according to the invention, illustrated purely as an example in the accompanying drawings in which:

FIG. 1 shows, in a perspective view, a twist finger assembly provided with the new mechanism, with the fingers open;

FIGS. 2 and 3 show the same device with the fingers closed and open, respectively, in side elevation with certain parts in sectional form and still others removed so that others can be seen better.

DESCRIPTION OF THE PREFERRED EMBODIMENT

As can be seen from the above mentioned figures, the device for opening and closing the twist finger assemblies comprises a sleeve 1, provided with a fork shaped head 2, and wherein two fingers 3 and 4 are symmetrically pivoted by means of pins 5 and 6, respectively. Each finger, as best shown in FIG. 1, is integral with a hub 3', 4' rotatable on the respective pivot pin 5,6 and slidably supported in between parallel sidewalls 2*a*, 2*b*, 2*a'*, 2*b'*; of the fork of head 2.

The part comprising the gripping area 3*b*, 4*b* of the said fingers 3 and 4 is shaped in a conventional manner but instead of the customary gear segments or annular toothings concentric to the pivot pins 5 and 6, respectively, the invention provides the hub of each finger with a radial protrusion 3*a* and 4*a*, respectively, shown as an integral part of the hub extending from the respective pivot pin in a direction opposite to that of the finger.

Inside the sleeve 1, coaxially with respect to it, is mounted a rod 7 and this slides in a bush 8 which is also housed in the inside of sleeve 1.

The rod 7, as shown, has a forked outer or forward end 7*a* adjacent the pivot pins 5 and 6 of the fingers 3 and 4 are located. The rod has an inner or rearward end, which protrudes from the sleeve, and terminates at a mechanism with which it is operated. This mechanism forms part of the subject matter of the aforementioned application of the same applicant as herein, and the under mentioned parts of it are shown on the accompanying drawing. Two more bushes 9 and 10 are provided for guiding the rod and, coaxially mounted on the two bushes respectively, there are two thrust bearings 11 and 12. A gear disk 13 rides on bush 9 and is inclined relative to it, this disk being structured in its plane in the form of a cam. A return spring 14 acts on disk 13, tending to shift it and thereby thrust bearing 11, bush 9, and rod 7 forwardly. Also provided are a cap 15 for the said spring 14, a lock nut 16, another bearing 17, a circular slide guide 18, and guide members 19 engaging the cam type gear disk 13 for reacting to rotary movement of the latter by axially shifting it. The gear and cam disk 13, having teeth 13', is rotated by suitable drive means, not shown. As already mentioned, the sleeve 1 and rod 7 are rotated in unison. This is done by suitable rotating means M.

The free end of each of the aforementioned radial protrusions 3*a* and 4*a* of the fingers 3 and 4 has articulated to it, through a pin 20 and 21, respectively, the end of a link 22 and 23, respectively, the other end of which is articulated, through a common pin 24, to the aforementioned extremity 7*a* of the rod 7.

The coordination of the parts 3*a*–4*a*, 22–23 and 7*a* of the rod is such that the angles formed between the pins 5–6 and the pins 20–21 and between the latter and the common pin 24 are always acute, and preferably vary in magnitude from around 54° when the fingers are closed, to around 73° when they are open.

The way in which the parts are arranged is, furthermore, such that, when the fingers are in their closed position, the axes of pins or trunnions 20–21 between the radial protrusions 3–4 and the respective links 22–23 lie, with respect to the plane of symmetry of the fingers, on the outside of the planes parallel with the axis of the rod 7 passing through the axes of pins 5–6 that serve for the rotation of the said fingers.

What is claimed is:

1. A twist finger device, comprising;

a pair of fingers, each having a gripping member rigid therewith and disposed to be alternately (a) in a gripping position closely adjacent the gripping member of the other finger for gripping tubular wrap portions of candies and similar products between the gripping members to twist the gripped wrap portions and (b) in a releasing position spaced from the gripping member of the other finger, each finger also having an actuator member extending therefrom and rigid therewith;

a pair of pivot pins, one for each finger, pivotally supporting the finger and located, parallel to one another between the gripping and actuator members of the finger;

a sleeve having an end portion supporting the pivot pins to support the fingers;

a rod slidably mounted in the sleeve for controlling the fingers and having an end portion which extends to a location adjacent the pivot pins;

means for rotation of the sleeve and rod;

a pair of links, each articulated at one point thereof to the end portion of the rod and at another point thereof to the actuator member of one of the fingers; and means for reciprocatingly sliding the rod relative to the sleeve during their rotation for pivoting the fingers about the pivot pins by the links articulated to the rod and the actuator members, to alternately place the gripping members of the fingers in the gripping and releasing positions, an acute angle being defined, in a plane at right angles to the pivot pins, by (1) a line from the pivot pin of each finger to the point where the respective link is articulated to the finger's actuator member, and (2) a line from the latter point to the point where the respective link is articulated to the end portion of the rod, when the gripping members of the fingers are in the gripping position.

2. A device according to claim 1 in which said angle is also acute when the gripping members of the fingers are in the releasing position.

3. A device according to claim 2 in which the fingers and links are symmetrical to the sleeve and rod, and said angle is the same, in each of said positions, for each finger.

4. A device according to claim 3 in which said angle is about 54 degrees when the gripping members of the fingers are in the gripping position, and is about 73 degrees when they are in the releasing position.

5. A device according to claim 3, wherein when the gripping members of the fingers are in gripping position, the point where each finger is articulated with respective link lies, with respect to a plane of symmetry of the fingers, on the outside of a plane, parallel with the axis of the rod, passing through the axis of the respective pivot pin.

6. A device according to claim 1 also including a spring acting on the rod to resiliently assist the sliding of the rod when the fingers are pivoted to place their gripping members in the gripping position.

7. A device according to claim 1 in which the end portion of the sleeve is fork-shaped and has mutually parallel walls, facing one another, and each finger has a hub, held on and between said walls by the respective pivot pin.

* * * * *